US010836616B2

(12) United States Patent
Raymond et al.

(10) Patent No.: US 10,836,616 B2
(45) Date of Patent: Nov. 17, 2020

(54) LUFFING JIB CRANE WITH A DEVICE FOR LOCKING THE JIB IN A RAISED CONFIGURATION

(71) Applicant: Manitowoc Crane Group France, Dardilly (FR)

(72) Inventors: Sylvain Raymond, Champfromier (FR); Lotfi Bouskine, Caluire et Cuire (FR); Gabriel Fraisse, Anse (FR); Sylvain Brunet, Lyons (FR); Anthony Champcenest, Charlieu (FR)

(73) Assignee: Manitowoc Crane Group France, Dardilly (FR)

( * ) Notice: Subject to any disclaimer, the term of this patent is extended or adjusted under 35 U.S.C. 154(b) by 231 days.

(21) Appl. No.: 16/155,630

(22) Filed: Oct. 9, 2018

(65) Prior Publication Data

US 2019/0106305 A1 Apr. 11, 2019

(30) Foreign Application Priority Data

Oct. 9, 2017 (FR) ..... 17 59435

(51) Int. Cl.
*B66C 23/82* (2006.01)
*B66C 23/16* (2006.01)
(Continued)

(52) U.S. Cl.
CPC ..... *B66C 23/828* (2013.01); *B66C 23/16* (2013.01); *B66C 23/26* (2013.01); *B66C 23/62* (2013.01);
(Continued)

(58) Field of Classification Search
CPC ..... B66C 23/16; B66C 23/26; B66C 23/62; B66C 23/82; B66C 23/828; B66C 23/90; B66C 23/92; F15B 15/26; F15B 15/261
(Continued)

(56) References Cited

U.S. PATENT DOCUMENTS 2,393,312 A * 1/1946 Davenport ..... B66C 23/92 212/280
3,982,648 A * 9/1976 Luedtke ..... E02F 3/388 414/713
4,039,093 A * 8/1977 Schmitz, Jr. ..... B66C 23/88 414/680
(Continued)

FOREIGN PATENT DOCUMENTS

CN 203474324 U 3/2014
DE 102015119381 B3 4/2017
(Continued)

OTHER PUBLICATIONS

French Search Report issued by INPI in connection with FR1759435 dated Jun. 1, 2018.

*Primary Examiner* — Michael R Mansen
*Assistant Examiner* — Juan J Campos, Jr.
(74) *Attorney, Agent, or Firm* — Levenfeld Pearlstein, LLC

(57) ABSTRACT

A crane includes a luffing jib and a lifting cylinder having a cylinder body and a movable rod hinged on the jib to displace the jib in lifting motion and in lowering motion, and a locking device adapted to cooperate with the lifting cylinder to mechanically lock the rod in a deployed holding position and block the jib in a raised holding configuration. The crane further includes a spacer hinged on the jib and supporting a stop, the spacer pivotable between a release position in which the spacer is shifted, allowing the movable rod to be freely displaced, and a locking position in which the spacer is folded so that the stop is capable of abutting on a bearing surface in a ball jointed connection with the cylinder body, to fixedly hold the movable rod in the deployed holding position.

19 Claims, 7 Drawing Sheets

(51) Int. Cl.

| | |
|---|---|
| ***B66C 23/90*** | (2006.01) |
| ***B66C 23/26*** | (2006.01) |
| ***B66C 23/92*** | (2006.01) |
| ***B66C 23/62*** | (2006.01) |
| ***F15B 15/26*** | (2006.01) |

(52) U.S. Cl.
CPC ..... *B66C 23/82* (2013.01); *B66C 23/90* (2013.01); *B66C 23/92* (2013.01); *F15B 15/26* (2013.01); *B66C 2700/0392* (2013.01)

(58) Field of Classification Search
USPC ..... 212/292
See application file for complete search history.

(56) References Cited

U.S. PATENT DOCUMENTS 4,043,253 A * 8/1977 Albright ..... E02F 3/388 92/25
4,073,345 A * 2/1978 Miller ..... A01B 63/22 172/413
5,009,566 A * 4/1991 Asche ..... E02F 3/388 414/685
5,163,803 A * 11/1992 Marola ..... B60P 3/125 280/402
5,634,762 A * 6/1997 Kim ..... E02F 9/24 414/685
6,149,374 A * 11/2000 Dershem ..... E02F 3/3414 212/292
6,171,050 B1 * 1/2001 Johnson ..... E02F 3/34 414/685
7,160,076 B2 * 1/2007 Curl ..... E02F 3/388 172/481
7,614,842 B2 * 11/2009 Ellefson ..... E02F 3/283 298/17 R
8,726,622 B2 * 5/2014 Wagner ..... A01D 41/145 56/15.9
9,567,855 B1 * 2/2017 Kundel ..... F01B 25/00
2012/0152109 A1 * 6/2012 Wagner ..... A01D 75/20 92/14
2014/0157746 A1 * 6/2014 Dilts ..... A01D 41/145 56/208

FOREIGN PATENT DOCUMENTS

WO 2016201270 A1 12/2016
WO 2017109309 A1 6/2017

* cited by examiner

LUFFING JIB CRANE WITH A DEVICE FOR LOCKING THE JIB IN A RAISED CONFIGURATION

CROSS-REFERENCE TO RELATED APPLICATION

This application claims priority under 35 U.S.C. § 119(a) to French Patent Application No. 17/59435, filed on Oct. 9, 2017, the disclosure of which is incorporated by reference herein in its entirety.

FIELD

The present invention relates to a luffing jib crane, and in particular to a luffing jib tower crane. In addition, the present invention concerns a luffing jib crane provided with a hoisting cylinder adapted to act on the jib in order to displace it in lifting motion and in lowering motion. The present invention may be applied to several crane structures, for example to structures composed of lattices and chords.

BACKGROUND

There is known, in particular from document WO 2017/109309, a luffing jib crane provided with a lifting cylinder, this lifting cylinder comprising a cylinder body mechanically connected to a structure element of the crane and a movable rod hinged on the luffing jib, wherein the movable rod is displaceable within the cylinder body between at least one deployed position and at least one retracted position to displace the luffing jib in lifting motion and in lowering motion between at least one raised configuration and at least one lowered configuration.

In case of strong winds, for example, it is recommended, to perform a weathervaning of the jib, by declutching the jib (in other words by unblocking the orientation brakes) so that it freely rotates so as to be automatically oriented in the direction of the wind and thus allow leaving the crane without human supervision. In the case of a luffing jib crane, the weathervaning is performed with the jib in a desired raised configuration corresponding to a fairly accurate configuration to minimize the radius of gyration of the jib and thus prevent the weathervaning jib from overflying areas in the proximity of the construction site, such as traffic ways, building and the like.

Moreover, for compliance with the local standards or regulations, it may be provided that the jib is held in the desired raised configuration even in service, when the crane handles a load, in order to prevent the jib and the hanging load from overflying such areas in the proximity of the construction site.

Thus, it is desirable to maintain the jib in the desired raised configuration, in order to avoid overflying the prohibited areas, even for very long periods, up to several months without supervision.

When the jib is weathervaning, the wind pushes backwards on the jib, generating forces on the lifting cylinder, and it is henceforth desirable that the lifting cylinder does not deform, and in particular does not compress, with the risk of seeing the jib lowering and therefore overflying the prohibited areas.

Moreover, the raising or lowering movement of the jib is performed by the lifting cylinder, which may be a hydraulic or electric cylinder. This lifting cylinder is always connected between the structure element and the jib, which results in controlling the movement of the jib in the rise direction (in lifting motion) and also in the descent direction (in lowering motion).

However, in the particular case of a crane with a hydraulic lifting cylinder, when the jib should be held in the desired raised configuration, the jib is well retained in both directions by the lifting cylinder, but hydraulic fluid leakages and/or expansion phenomena of the hydraulic fluid may cause a compression of the lifting cylinder (in other words a retraction of the movable rod), which may lead to an uncontrolled and undesired lowering of the jib; such hydraulic fluid leakages may be both internal to the lifting cylinder and external at the joints or hoses of the hydraulic system.

SUMMARY

The present invention aims to overcome all or part of the aforementioned drawbacks, by proposing a locking device which blocks movement of the luffing jib from a raised holding configuration, regardless of the external conditions, and even for long periods when the jib is weathervaning in the raised holding configuration without human control.

Thus, the invention aims at providing a fixed reach of the jib to substantially avoid overflying areas in the vicinity of the construction site, even under high wind conditions.

Another object of the invention is to provide, during the locking of the luffing jib in the raised holding configuration, a force path between the jib and the cylinder body which is aligned substantially or entirely, with the cylinder body to substantially avoid bending in this cylinder body.

To this end, a crane comprising a luffing jib and a lifting cylinder is proposed, this lifting cylinder extending along a longitudinal axis and comprising a cylinder body mechanically connected to a structure element of the crane and a movable rod hinged on the luffing jib, wherein the movable rod is displaceable within the cylinder body between at least one deployed position and at least one retracted position to displace the luffing jib in lifting motion and in lowering motion between at least one raised configuration and at least one lowered configuration, wherein the crane further comprises a locking device adapted to cooperate with the lifting cylinder to mechanically lock the movable rod in a deployed holding position and thus block the luffing jib in a raised holding configuration, wherein this locking device comprises a spacer provided with a proximal portion hinged on the jib and a distal portion supporting a stop, wherein this spacer is pivotally movable on the jib between:

- a release position in which the spacer is shifted opposite the lifting cylinder such that its distal portion is brought away from the lifting cylinder, allowing the movable rod to be displaced within the cylinder body and to act on the displacement of the luffing jib; and
- a locking position in which the spacer is folded over the lifting cylinder such that the stop is capable of bearing on the cylinder body after a retraction of the movable rod;

wherein this cylinder body includes, at a front end crossed by the movable rod, a bearing device comprising:

- a bearing rim having an annular upper surface forming a bearing surface for the stop; and
- a support ring fixedly mounted on the front end of the cylinder body, wherein the bearing rim is coupled to the support ring according to a ball joint connection with three rotational degrees of freedom;

and in that the movable rod is pivotally hinged on the jib according to a main pivot axis, and the proximal portion of the spacer is hinged on the jib according to a pivot axis aligned with said main pivot axis by means of a mechanical setting system enabling setting of the alignment between said pivot axes, such that, in a locking phase, the stop is bearing on the bearing surface of the bearing rim so that the spacer fixedly holds the movable rod in the deployed holding position to lock the luffing jib in the raised holding configuration, wherein the locking device is compressed between, on one side, the body of the cylinder and, on the other side, the jib with a compression forces path aligned with the longitudinal axis of the lifting cylinder thanks, on the one hand, to the bearing device which enables setting of the bearing of the stop on the body of the cylinder and, on the other hand, to the mechanical setting system which enables setting of the alignment of the pivot axes of the movable rod and the spacer.

Thus, this locking device with a pivoting spacer enables accurate blocking of the jib in the raised holding configuration, so that the crane may be weathervaning (that is to say freely rotating to be automatically oriented in the direction of the wind).

Moreover, the bearing device may provide an annular bearing surface for the stop which, due to the ball joint connection with the support ring, allows both transmitting the forces from the stop to the cylinder body, and correcting possible misalignments with the cylinder body, which may originate, for example, from manufacturing defects and/or mounting defects.

Moreover, the mechanical setting system is configured to allow corrections of possible misalignment defects between the pivot axes of the movable rod and the spacer, and thus may allow an optimized transmission of the forces from the jib up to the cylinder body, via the ball jointed bearing device. Indeed, this mechanical setting system will allow adjusting the position of the spacer and thus accommodate alignment or substantial alignment of the spacer with the cylinder body, in addition to the stop device, which will provide a locking device (spacer+stop) forming a rigid assembly which can take up the compression forces to hold the jib in a raised holding configuration.

According to an embodiment, the bearing rim has an annular lower surface, opposite to the bearing surface, forming a first coupling surface, and the support ring has an annular upper surface forming a second coupling surface, wherein the first coupling surface and the second coupling surface are in ball jointed bearing to provide bearing of the stop on the bearing surface of the bearing rim which is evenly distributed on each side of the longitudinal axis of the lifting cylinder.

According to an embodiment, one of the first coupling surface and the second coupling surface is spherical shaped, and the other of the first coupling surface and the second coupling surface is spherical or conical shaped.

According to an embodiment, one of the first coupling surface and the second coupling surface defines a male bearing seat whereas the other of the first coupling surface and the second coupling surface defines a female bearing seat.

Embodiments of the present invention also provide that the spacer includes a first longitudinal beam and a second longitudinal beam which have respectively:

- proximal ends supporting respectively a first hinge and a second hinge which mechanically and pivotally connect the first longitudinal beam and the second longitudinal beam to the jib; and
- distal ends between which the stop extends;

and the movable rod has a front end supporting a central hinge which, on the one hand, mechanically and pivotally connects the movable rod to the jib and, on the other hand, is disposed between the first hinge and the second hinge, and furthermore, this central hinge, the first hinge and the second hinge are all pivoting according to the same main pivot axis due to the mechanical setting system enabling setting of the alignment between the pivot axes of said hinges.

According to an embodiment:

- the first hinge comprises a first cylindrical bearing, secured to the proximal end of the first longitudinal beam, pivotally mounted about a first cylindrical shaft mounted inside said first bearing, said first shaft being mounted on a first support fastened on the jib; and
- the second hinge comprises a second cylindrical bearing, secured to the proximal end of the second longitudinal beam, pivotally mounted about an eccentric system designed to rectify a misalignment between the first bearing and the second bearing, said eccentric system being mounted on a second support fastened on the jib;

wherein this eccentric system is part of or constitutes the mechanical setting system enabling setting of the alignment between the pivot axes of the first hinge and the second hinge with the main pivot axis of the central hinge.

According to one possibility, the eccentric system comprises:

- at least one cylindrical ring received inside the second bearing and provided with an eccentric bore;
- a second shaft provided with a cylindrical portion received inside the eccentric bore of the ring, said ring being pivotally mounted about said cylindrical portion, said second shaft being mounted on the second support;
- an immobilization device arranged to immobilize the at least one ring on the second support pivoting about the second shaft in an angular position selected from several angular positions to allow correction of a misalignment between the first bearing and the second bearing;
- a locking device arranged to fixedly lock the ring and the second shaft on the second support and thus to hold the eccentric system secured to the second support.

According to an embodiment, the at least one ring is provided with peripheral orifices distributed around the eccentric bore, each peripheral orifice corresponding to a given angular position, and the immobilization device comprises a peg passing through the peripheral orifice corresponding to the selected angular position, said peg also passing through a locking hole formed on the second support and oblong-shaped to enable a displacement of the peg inside this locking hole during setting of the alignment between the pivot axes.

Advantageously, the second support has at least two oblong-shaped locking holes in order to be able to receive the peg in any of the locking holes and thus provide two additional degrees of setting of the alignment of the pivot axes.

According to an embodiment, the locking device comprises a locking rod passing through the second shaft and the second support to cooperate with a clamping member (such as for example a nut) adapted to clamp the at least one ring against the second support in order to secure the eccentric system and the second support.

According to an embodiment, the eccentric system comprises two identical rings disposed on either side of the second support, wherein the second shaft has two cylindrical portions at its respective ends which are received inside the eccentric bores of the two respective rings.

According to an embodiment, the second support has an oblong housing receiving the second shaft thereinside, wherein this second shaft has a central portion slidably mounted inside this oblong housing, such that this housing provides a setting clearance for the central portion which allows, during setting of the pivot axes with the eccentric system, a displacement for the second shaft in the housing.

In accordance with embodiments described herein:

the first hinge comprises a first clevis provided with two flanges provided with opposing cylindrical main orifices defining the first bearing for the first shaft, the first support is formed by a plate received between the two flanges of the first clevis and provided with a cylindrical upper orifice and a cylindrical lower orifice crossed respectively by an upper shaft and a lower shaft, wherein the first hinge is configurable between:

a service position in which the first support is fastened and locked on a first stirrup secured to the jib by means of the lower shaft and the upper shaft which pass through the first stirrup and which pass respectively through the lower orifice and the upper orifice of the first support; and a stowed position in which, compared to the service position, the upper shaft no longer passes through the first stirrup and only the lower shaft, remained in place on the first stirrup, ensures fastening of the first support on the first stirrup after a pivoting tilting of the first support about this lower shaft clearing an access to the central hinge of the movable rod on the jib;

the second hinge comprises a second clevis equipped with two flanges provided with opposing cylindrical main orifices defining the second bearing for the eccentric system, the second support is formed by a plate received between the two flanges of the second clevis and provided with a cylindrical upper orifice and a cylindrical lower orifice crossed respectively by an upper shaft and a lower shaft, wherein the second hinge is configurable between:

a service position in which the second support is fastened and locked on a second stirrup secured to the jib by means of the lower shaft and the upper shaft which pass through the second stirrup and which pass respectively through the lower orifice and the upper orifice of the second support; and a stowed position in which, compared to the service position, the upper shaft no longer passes through the second stirrup and only the lower shaft, remained in place on the second stirrup, ensures fastening of the second support on the second stirrup after a pivoting tilting of the second support about this lower shaft clearing an access to the central hinge of the movable rod on the jib.

Thus, by placing the first hinge and the second hinge in the stowed position, the central hinge of the movable rod is accessible in the event the central hinge is to be repaired or replaced. With this stowage, it is possible to clear the access to the central hinge to dismount it, and this even if the jib is in height and therefore without resorting to a lowering of the jib down to the ground.

According to an embodiment:

the flanges of the first clevis are provided with two opposing secondary orifices shaped so that, in the stowed position, the concerned upper shaft locks the first support by simultaneously passing through these two secondary orifices and the upper orifice of the first support;

the flanges of the second clevis are provided with two opposing secondary orifices shaped so that, in the stowed position, the concerned upper shaft locks the second support by passing through both these two secondary orifices and the upper orifice of the second support.

According to an embodiment, the stop comprises an arcuate central portion defining a groove inside which the movable rod is positioned in the locking position, and stop elements are fastened on the central portion, on either side of the groove, wherein these stop elements face the bearing surface of the bearing rim in the locking position.

According to an embodiment, the stop elements are in the form of stop plates defining planar stop surfaces adapted to abut against the bearing surface of the bearing rim.

In accordance with an embodiment described herein, the crane may be a tower crane.

The invention also relates to a method for locking a luffing jib in a raised holding configuration, this method being implemented in a crane in accordance with the invention by implementing the following locking sequence:

in a first phase or service phase, providing the spacer in the release position such that the movable rod is free to be displaced within the cylinder body so as to act on the displacement of the luffing jib;

in a second phase or transition phase, deploying the movable rod up to a deployed transition position, beyond the deployed holding position, and the spacer is displaced up to its locking position by being folded over the movable rod;

in a third phase or locking phase, retracting the movable rod from the deployed transition position to the deployed holding position until the stop bears on the bearing surface of the bearing rim so that the spacer fixedly holds the movable rod in the deployed holding position so as to lock the luffing jib in the raised holding configuration.

In an embodiment, once the locking device has locked the luffing jib in the raised holding configuration, a step of weathervaning the jib is provided, which includes declutching of the jib so that it freely rotates so as to be automatically oriented in the direction of the wind.

According to some embodiment, on completion of the locking phase, the stop bears on the cylinder body with a tolerance in the range of 0.5 to 5 centimeters. In other words, the stop may effectively bear on the cylinder body (in this case the tolerance is zero), or else the stop may be at a given distance (equivalent to the aforementioned tolerance) of the cylinder body. Indeed, in this locking phase, it may be provided to automatically stop the retraction of the movable rod, such that this tolerance will allow taking into consideration the latency between a detection of the position of the stop made by an appropriate sensor which will serve to control the stoppage of the retraction of the movable rod, and the effective stoppage of the movable rod in its retraction movement. This tolerance will depend on the retraction speed of the movable rod during the locking phase.

BRIEF DESCRIPTION OF THE DRAWINGS

Other features and advantages of the present invention will appear on reading the detailed description hereinafter, of a non-limiting example of implementation, made with reference to the appended figures in which.

DESCRIPTION

Figure 1:
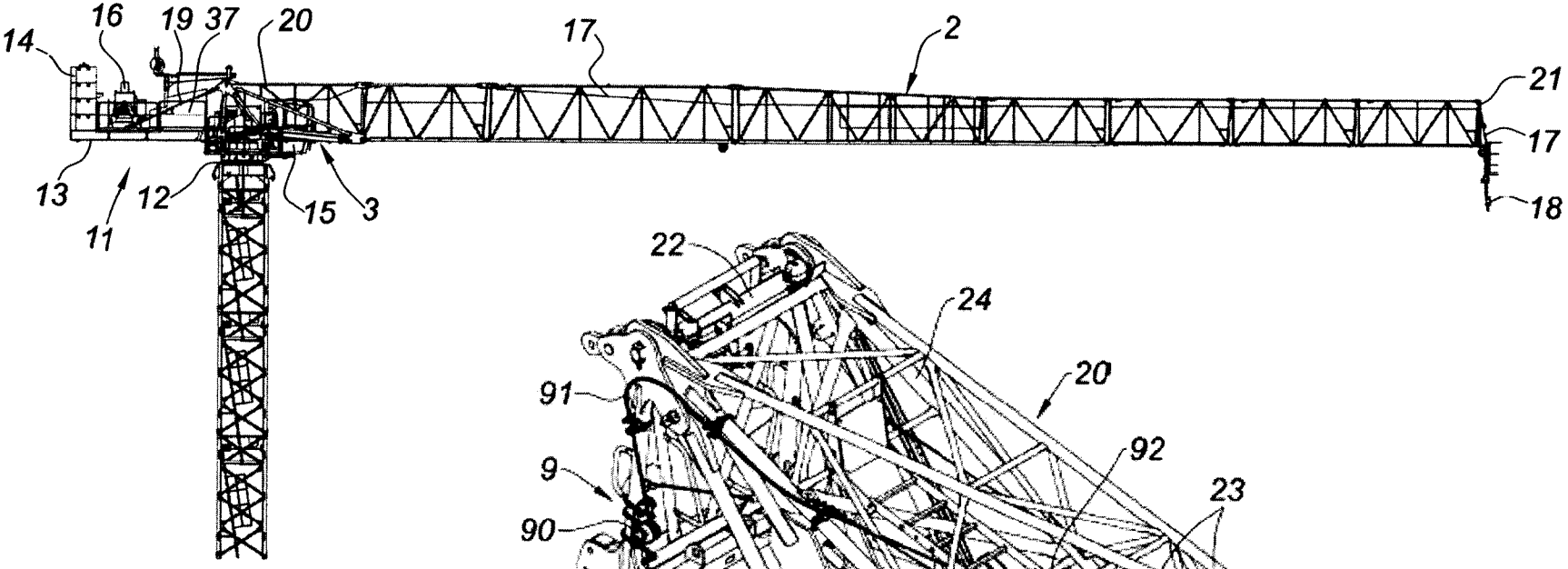
FIG. 1 is a side and partial schematic view of a luffing jib crane in accordance with an embodiment, wherein the locking device is omitted for clarity.

According to some embodiments, the luffing jib crane 1, shown in FIG. 1, may be a tower crane which comprises a vertical mast 10 anchored or movable on the ground, surmounted, via an orientation device, by a rotating portion 11 mainly comprising a rotating pivot 12, a counter-jib 13 on which a counterweight 14 is mounted, and a luffing jib 2.

The rotating pivot 12 is orientable about the vertical axis of the mast 10 and may support a cabin 15 for driving the crane 1.

The counter-jib 13 extends substantially horizontally rearwardly, from the rotating pivot 12, and it carries, for example, a hoisting winch 16 for hoisting the loads hanging from the jib 2, as well as the counterweight 14. This counter-jib 13 is suspended by means of tie rods 19.

The hoisting winch 16 has a drum on which a hoisting cable 17 is wound, which passes over pulleys, then is directed towards the tip 21 of the jib 2 and extends up to a hoisting hook 18, with or without reeving, the loads to be lifted hanging from the hook 18 during the use of the crane 1.

The luffing jib 2 is formed by a lattice structure, for example with a triangular section, and it has a proximal portion 20 hinged, about a horizontal pivot axis 22, on the rotating pivot 12. This proximal portion 20 forms the foot of the jib 2.

The proximal portion 20 has upper beams 23 and lower beams 24 interconnected by chords and by a lower cross-member 25 located at the end (that is to say opposite to the pivot axis 22) and in the lower part of the proximal portion 20. In the lowered configuration of the jib 2 shown in FIGS. 1 and 3, when the jib 2 is horizontal, the upper beams 23 extend substantially horizontally, whereas the lower beams 24 extend obliquely relative to the horizontal.

Figure 3:
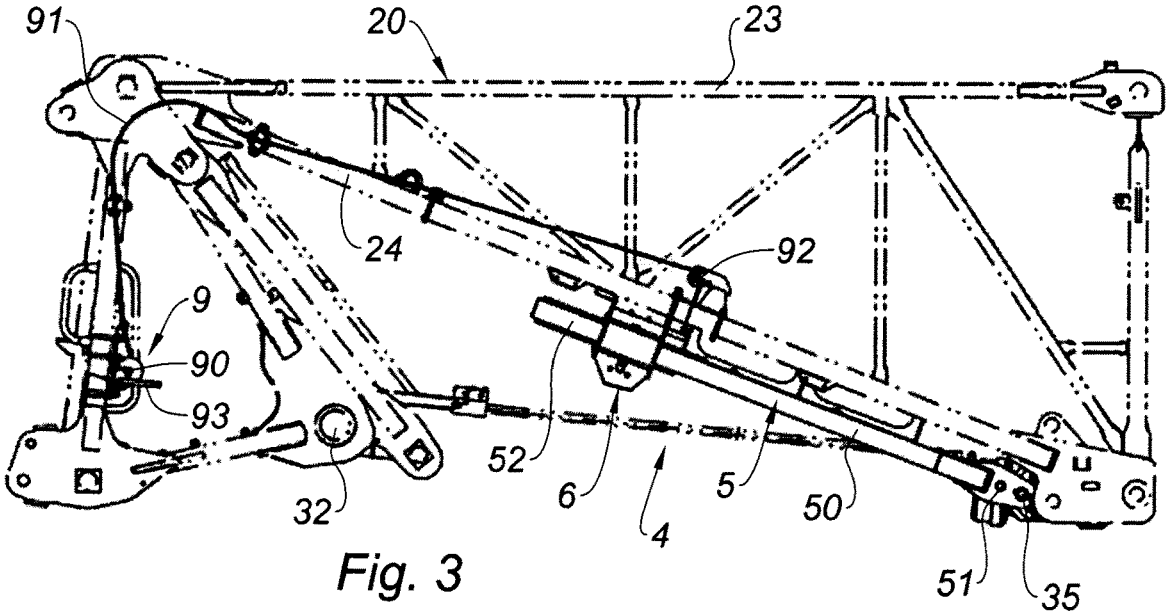
FIG. 3 is a side schematic view of the proximal portion of the jib illustrated in FIG. 2.
Figure 4:
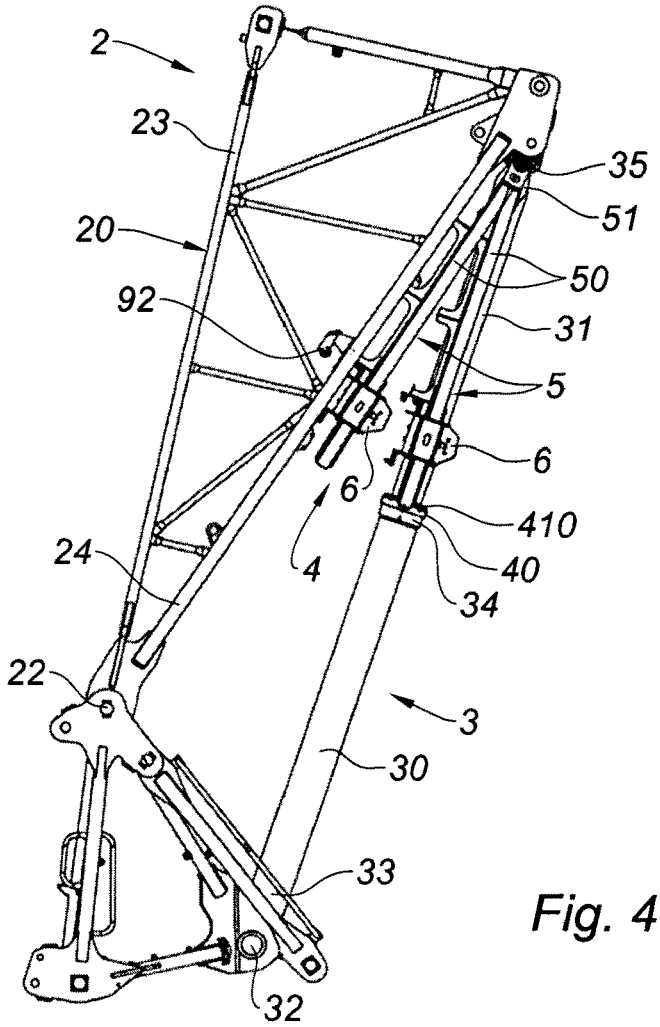
FIG. 4 is a side and partial schematic view of a crane in accordance with an embodiment, wherein the jib is raised in a raised transition configuration with the movable rod of the lifting cylinder in a deployed transition position, and wherein the spacer is illustrated both in a release position and in a locking position.
Figure 5:
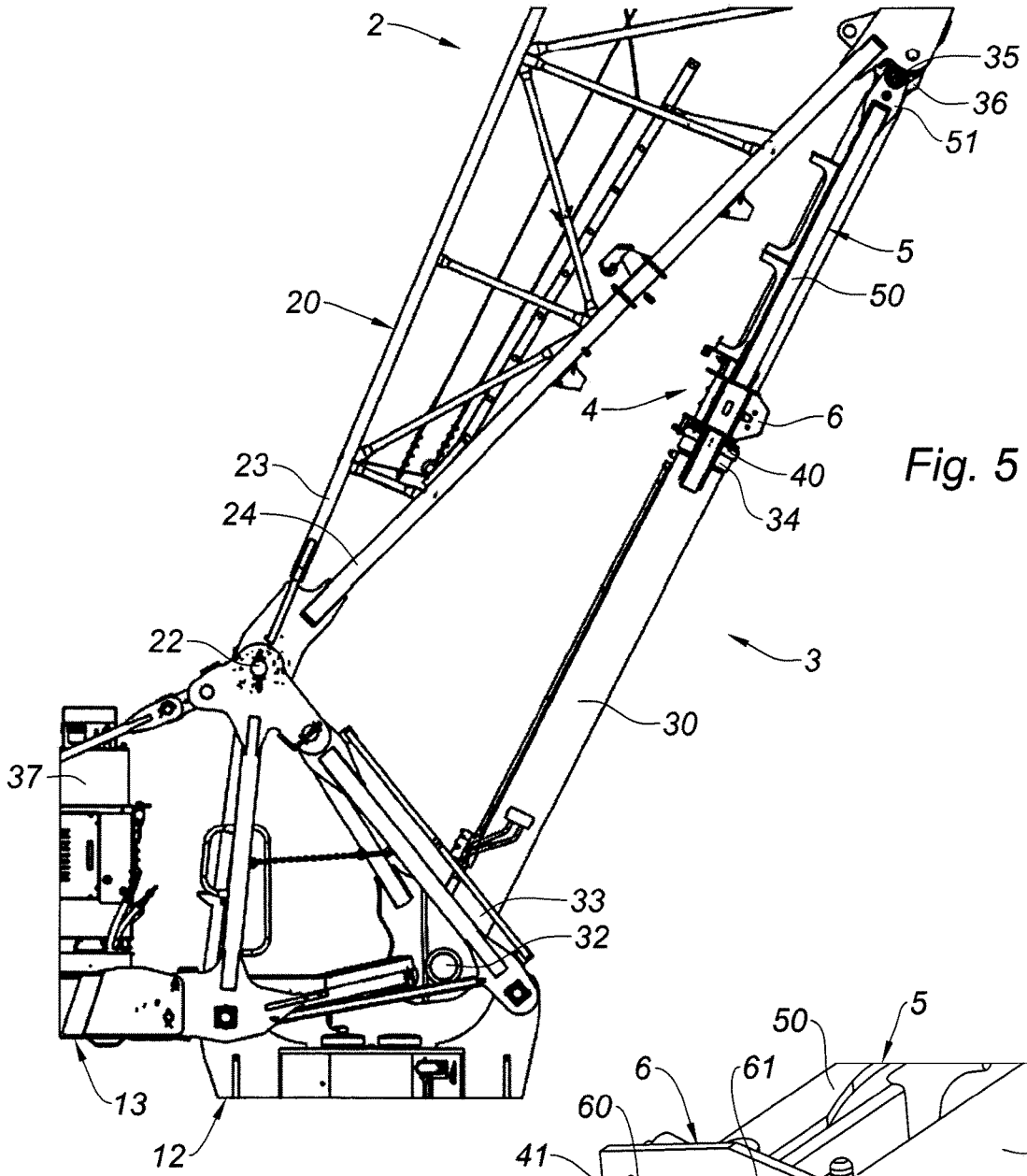
FIG. 5 is a side and partial schematic view of the crane of FIG. 4, wherein the jib is locked in a raised holding configuration with the movable rod of the lifting cylinder blocked by means of the spacer and the stop in a deployed holding position (the movable rod having been retracted compared to FIG. 4)

The crane 1 further comprises a lifting cylinder 3 which may be of the hydraulic linear cylinder or electric linear cylinder type. This lifting cylinder 3 can act on the proximal portion 20 of the jib 2 to displace the jib 2 between at least one lowered position (as shown in FIGS. 1 and 3) and at least one raised position (as shown in FIGS. 4 and 5). The lifting cylinder 3 comprises a cylinder body 30 and a movable rod 31.

The cylinder body 30 is mechanically connected to the rotating pivot 12 by a pivot connection about a horizontal pivot axis 32. As such, the cylinder body 30 has:

- a rear end 33 supporting a hinge, such as a hinge ball joint, which mechanically connects the cylinder body 30 to the rotating pivot 12; and
- an open front end 34 through which the movable rod 31 opens.

The movable rod 31 is mechanically connected to the proximal portion 20 of the jib 2 by a pivot connection about a horizontal main pivot axis 35, such that this proximal portion 20 is movable between the lowered position and the raised position. When the crane 1 is in use, the lifting cylinder 3 allows raising or lowering the jib 2, via the proximal portion 20.

Figure 15:
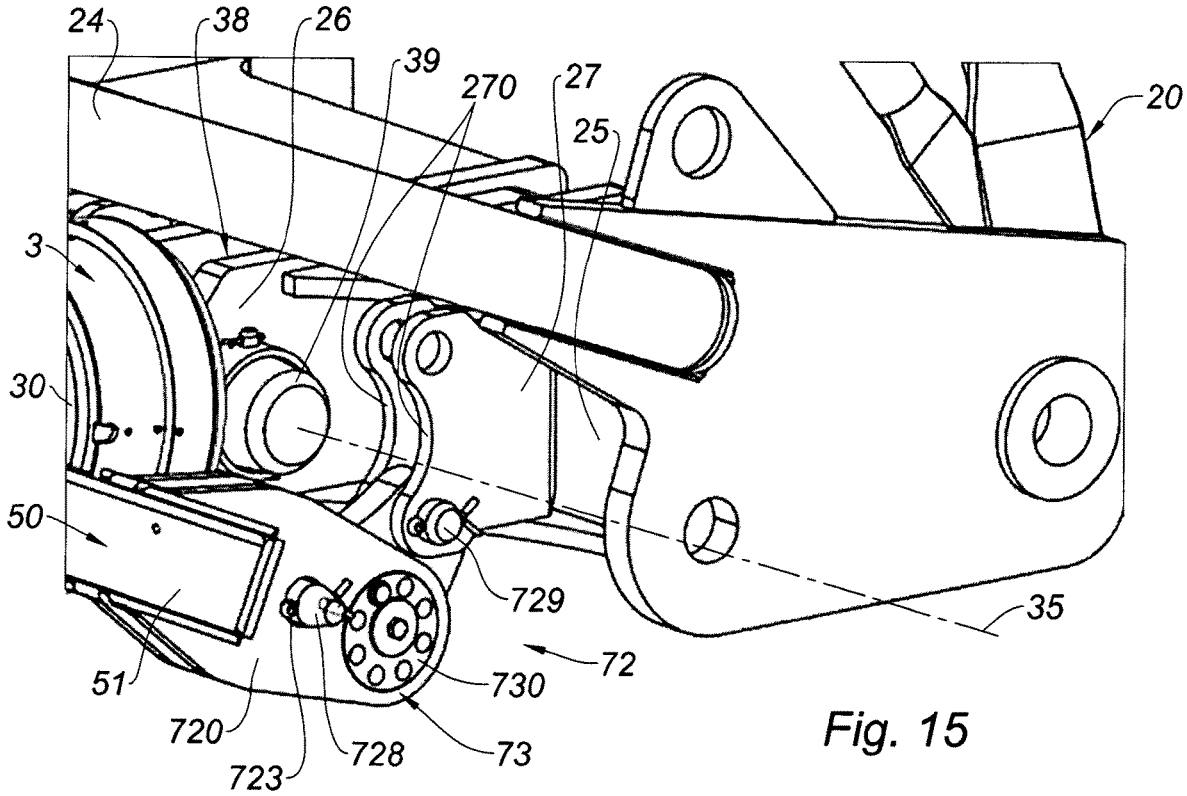
FIG. 15 is a schematic view similar to that of FIG. 14 with the second hinge in a stowed position.

The movable rod 31 thus has a front end 36 supporting a central hinge 38 (shown in FIG. 15), such as a hinge ball joint, which mechanically connects the movable rod 31 to the proximal portion 20 and which allows a pivoting about a central shaft 39 defining the main pivot axis 35, this central shaft 29 being supported by a central stirrup 26 secured to the proximal portion 20. In FIG. 15, the movable rod 31 is almost fully retracted inside the cylinder body 30, such that this movable rod 31 is not shown. The central shaft 39 is locked in position on the central stirrup 26.

Moreover, the cylinder body 30 includes, at its front end 34, a bearing device 40 comprising:

- a bearing rim 41; and
- a support ring 42 fixedly mounted on the front end 34 of the cylinder body 30, wherein the bearing rim 41 is coupled to the support ring 42 according to a ball joint connection with three rotational degrees of freedom.

Figure 9:
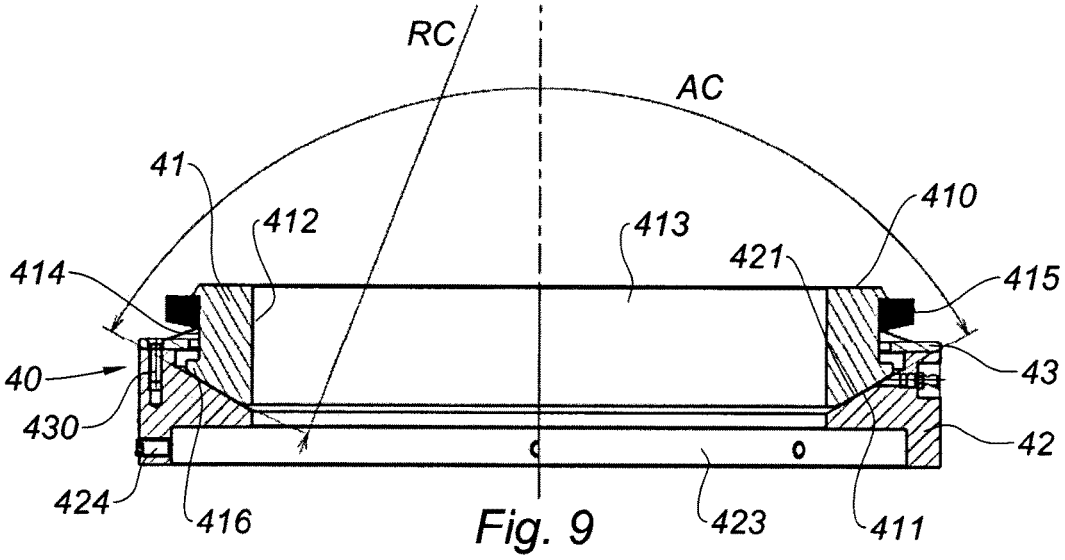
FIG. 9 is a mid-sectional schematic view of the stop device provided to be mounted on the cylinder body, according to an embodiment.

With reference to FIG. 9, the bearing rim 41 has a peripheral wall having:

- an annular upper surface forming a bearing surface 410 which is orthogonal to the movable rod 31;
- an annular lower surface opposite to the bearing surface 410 and forming a first coupling surface 411, wherein this first coupling surface 411 is spherical shaped according to a given radius of curvature RC;
- an internal peripheral surface 412 delimiting a central orifice 413 for the passage of the movable rod 31;
- an external peripheral surface 414 around which a sealing gasket 415 is mounted and which has a peripheral shoulder 416 which serves to hold the bearing rim 41 on the support ring 42, as described hereinafter.

The support ring 42 has an annular upper surface forming a conical shaped second coupling surface 421 at a given taper angle AC, wherein the first coupling surface 411 of the bearing rim 41 and the second coupling surface 421 of the support ring 42 are in ball jointed bearing, thus forming the coupling according to a ball joint connection.

The first coupling surface 411 defines a spherical male bearing seat bearing on the second coupling surface 421 which defines a conical female bearing seat.

Non-illustrated variants are also conceivable, such as the following non-limiting examples:

- the first coupling surface 411 defines a spherical male bearing seat bearing on the second coupling surface 421 which defines a spherical female bearing seat;
- the first coupling surface 411 defines a conical male bearing seat bearing on the second coupling surface 421 which defines a spherical female bearing seat;
- the first coupling surface 411 defines a spherical female bearing seat bearing on the second coupling surface 421 which defines a spherical male bearing seat;
- the first coupling surface 411 defines a spherical female bearing seat bearing on the second coupling surface 421 which defines a conical male bearing seat;
- the first coupling surface 411 defines a conical female bearing seat bearing on the second coupling surface 421 which defines a spherical male bearing seat.

The support ring 42 also has an upper surface, surrounding the second coupling surface 421, and on which is fastened, in particular by means of screws 430, a locking collar 43, which is positioned above the peripheral shoulder 416 of the bearing rim 41. Thus, this locking collar 43 and this peripheral shoulder 416 allow holding the bearing rim 41 on the support ring 42.

The support ring 42 also has an inner bore 423, crossed by the movable rod 31, wherein this inner bore 423 is mounted around the front end 34 of the cylinder body 30 and is fixedly locked by means of screws 424.

The lifting cylinder 3 is a linear cylinder configured so that the movable rod 31 is displaceable within the cylinder body 30 between at least one deployed position (as shown in FIGS. 4 and 5) and at least one retracted position to displace the jib 2 in lifting motion and in lowering motion between at least one raised configuration (as shown in FIGS. 4 and 5) and at least one lowered configuration (as shown in FIGS. 1 and 3).

The crane 1 further comprises a power supply device 37 which is configured to power the lifting cylinder 3 so as to raise the jib 2. In the case of a hydraulic lifting cylinder 3, the power supply device 37 is a hydraulic power unit configured to power the lifting cylinder 3 with hydraulic power. When powered, the lifting cylinder 3 can raise the jib 2. The power supply device 37 is fastened to the counter-jib 13 and is located relatively close to the lifting cylinder 3, opposite to the counterweight 14.

The lifting cylinder 3 extends in a vertical midplane of the jib 2, such that the central hinge 38 of the movable rod 31 on the proximal portion 20 of the jib 2 is located in a vertical midplane of the proximal portion 20. In one embodiment, the movable rod 31 is hinged on the lower crossmember 25, and more specifically in the middle of this lower crossmember 25. Thus, the central stirrup 26 supporting the central shaft 39 is secured (in particular by welding or bolting) to this lower crossmember 25.

The crane 1 further comprises a locking device 4 adapted to cooperate with the lifting cylinder 3 to mechanically lock the movable rod 31 of the lifting cylinder 3 in a deployed holding position (shown in FIG. 5) and thus block the jib 2 in a raised holding configuration.

Figure 6:
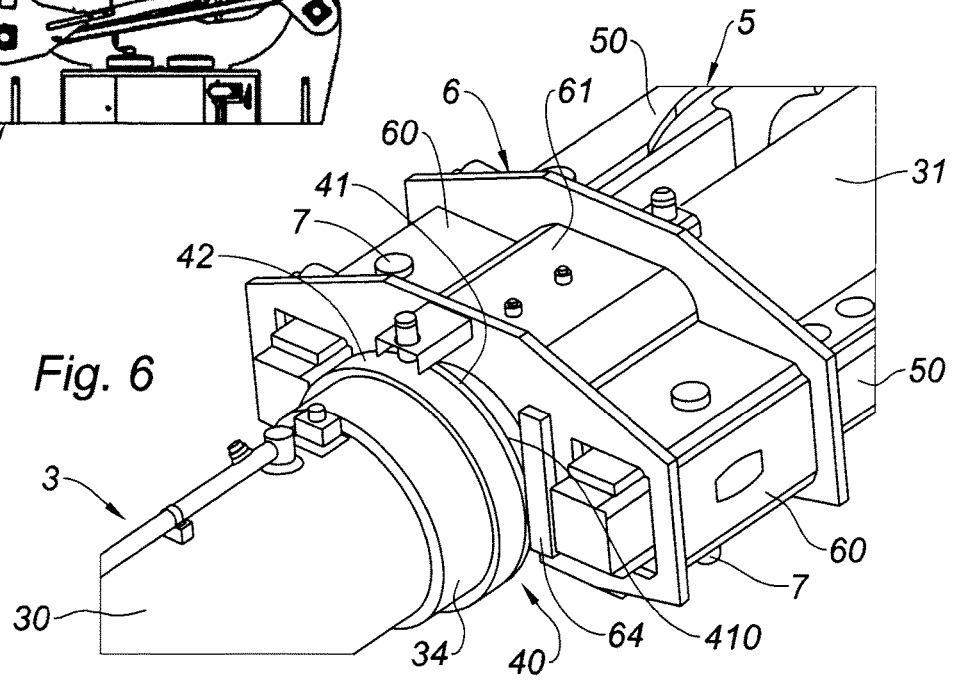
FIG. 6 is a partial and perspective schematic view of the spacer in the locking position, with the stop bearing on the cylinder body of the hoisting cylinder, according to an embodiment.
Figure 8:
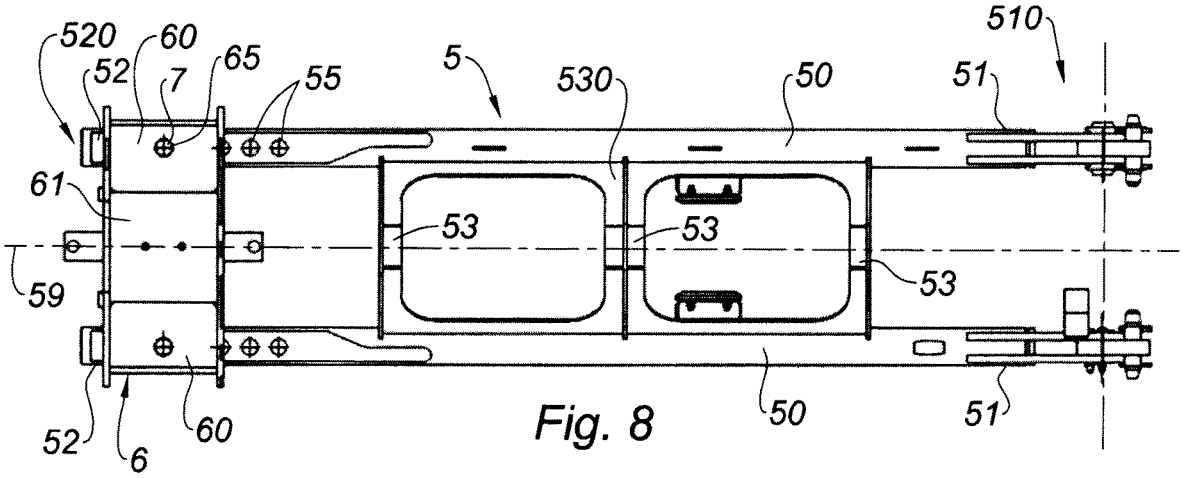
FIG. 8 is a top schematic view of a spacer with its stop, according to an embodiment.

This locking device 4 comprises a spacer 5 (shown only in FIG. 8) on which a stop 6 is mounted, wherein the spacer 5 is pivotally movable on the proximal portion 20 of the jib 2 between:

- a release position (shown in FIGS. 2 to 4) in which the spacer 5 is shifted relative to the lifting cylinder 3 while being raised in the direction of the proximal portion 20; and
- a locking position (shown in FIGS. 4 to 6) in which the spacer 5 is folded over the lifting cylinder 3, for example, on the movable rod 31.

Starting from the release position towards the locking position, the stop 6 follows a circular arc which brings it closer to the movable rod 31 until bearing on the movable rod 31. Conversely, starting from the locking position towards the release position, the stop 6 follows a circular arc which moves it away from the movable rod 31 and brings it closer to the proximal portion 20 of the jib 2.

The spacer 5 comprises a first longitudinal beam 50 and a second longitudinal beam 50 which are substantially parallel and which have respectively:

- proximal ends 51 hinged on the proximal portion 20 of the jib 2; and
- distal ends 52 between which the stop 6 extends.

According to an embodiment:

- the proximal end 51 of the first longitudinal beam 50 supports a first hinge 71 (shown in FIG. 10) which mechanically and pivotally connects the first longitudinal beam 50 to the proximal portion 20 of the jib 2; and
- the proximal end 51 of the second longitudinal beam 50 supports a second hinge 72 (shown in FIGS. 10, 11, 14 and 15) which mechanically and pivotally connects the second longitudinal beam 50 to the proximal portion 20 of the jib 2.

Thus, the spacer 5 comprises a proximal portion 510 composed of the proximal ends 51 of the two longitudinal beams 50, wherein this proximal portion 510 is mechanically connected to the proximal portion 20 of the jib 2 by a pivot connection about the main pivot axis 35 which, for reminder, corresponds to the pivot axis of the movable rod 31 on the proximal portion 20 of the jib 2. In other words, the pivot axis of the spacer 5 on the proximal portion 20 and the pivot axis of the movable rod 31 on the proximal portion 20 are coincident.

In some embodiments, the first longitudinal beam 50 is hinged on the lower crossmember 25, next to the central hinge 38, and the second longitudinal beam 50 is also hinged on the lower crossmember 25, of the other central hinge 38. Thus, the central hinge 38 is disposed between the first hinge 71 and the second hinge 72 and these three hinges 38, 71, 72 are all pivoting according to the same main pivot axis 35. That is, in one embodiment, the three hinges 38, 71, 72 may pivot on the same main pivot axis 35.

The first hinge 71 is hinged on a first stirrup (not shown in the Figures) secured (for example by welding or bolting) to the lower crossmember 25, and the second hinge 72 is hinged on a second stirrup 27 (shown in FIGS. 14 and 15) secured (for example by welding or bolting) to the lower crossmember 25, wherein the first stirrup and the second stirrup 27 are disposed on either side of the central stirrup 26.

The first hinge 71 comprises a first clevis 710 provided with two flanges 711 which are parallel and spaced apart from each other, wherein this first clevis 710 is securely fastened, for example by welding or bolting, on the proximal end 51 of the first longitudinal beam 50.

These two flanges 711 are provided with:

- two cylindrical main orifices 712 (i.e. a main orifice 712 per flange 711) defining a first cylindrical bearing which, for the rest, will bear the same reference 712; and
- two opposing cylindrical secondary orifices 713 (i.e. a secondary orifice 713 per flange 711).

The secondary orifices 713 are located closer to the proximal end 51 of the first longitudinal beam 50 than the main orifices 712, in other words the main orifices 712 are formed at the level of the ending of the first clevis 710.

Figure 10:
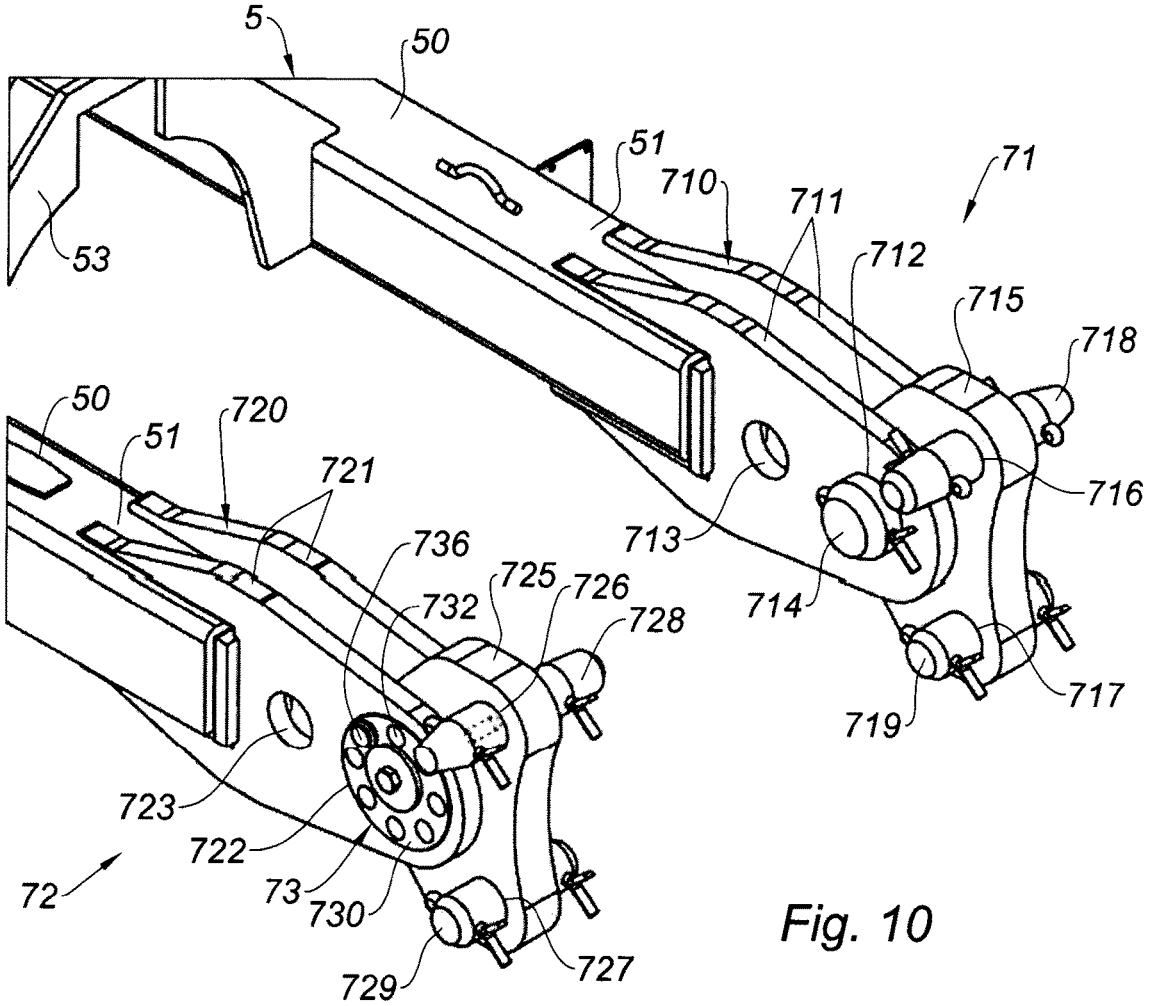
FIG. 10 is a partial and perspective schematic view of the proximal portion of the spacer in order to visualize the first hinge and the second hinge provided for the hinge of the spacer on the jib, according to an embodiment.

The first clevis 710 is pivotally mounted about a first cylindrical shaft 714 adjustably mounted inside the first bearing 713, this first shaft 714 passing through the first clevis 710 to cooperate with at least one locking member such as a pin (as illustrated in FIG. 10), a nut, a socket, a circlip, or any other suitable means providing a blocking or locking in translation of the first shaft 714 on the first clevis 710.

The first hinge 71 further comprises a first support 715 which is in the form of a plate received between the two flanges 711 of the first clevis 710 and which has a housing (not shown) crossed by the first shaft 714. Thus, the first shaft 714 is mounted on this first support 715, and it passes through both this first support 715 and the flanges 711 of the first clevis 710.

The first support 715 is provided with:

- a cylindrical upper orifice 716; and
- a cylindrical lower orifice 717 disposed below the upper orifice 716 in a substantially vertical direction when the jib 2 is horizontal.

This first support 715 is fastened on the first stirrup, secured to the lower crossmember 25, by means of:

- an upper shaft 718 which passes through both the first stirrup and the first support 715 across the upper orifice 716; and
- a lower shaft 719 which passes through both the first stirrup and the first support 715 across the lower orifice 717.

The upper shaft 718 and the lower shaft 719 cooperate respectively with at least one locking member such as a pin (as shown in FIG. 10), a nut, a socket, a circlip, or any other means providing a blocking or locking in translation of the upper and lower shafts 718, 719 on the first stirrup.

In order to promote the alignment of the pivot axes described above, it is provided to enable a setting of this alignment at the level of the second hinge 72 described below.

The second hinge 72 comprises a second clevis 720 provided with two flanges 721 parallel and spaced apart from each other, wherein this second clevis 720 is securely fastened, for example by welding or bolting, on the proximal end 51 of the second longitudinal beam 50.

These two flanges 721 are provided with:

- two opposing cylindrical main orifices 722 (i.e. a main orifice 722 per flange 721) defining a second cylindrical bearing which, for the rest, will bear the same reference 722; and
- two opposing cylindrical secondary orifices 723 (i.e. a secondary orifice 723 per flange 721).

The secondary orifices 723 are located closer to the proximal end 51 of the second longitudinal beam 50 than the main orifices 722, in other words the main orifices 722 are formed at the level of the ending of the second clevis 720.

The second clevis 720 is pivotally mounted about an eccentric system 73 designed to correct a misalignment between the first bearing 712 and the second bearing 722, to ultimately enable an alignment between the pivot axis of the spacer 5 on the jib 2 and the main pivot axis 35 of the movable rod 31 on the jib 2.

This eccentric system 73 comprises two cylindrical rings 730, which may be identical, wherein the rings 730 are received inside the second bearing 722. In one embodiment, a ring 730 is adjustably mounted inside the main orifice 722 of one of the flanges 721, and the other ring 730 is adjustably mounted inside the main orifice 722 of the other flange 721. Thus, the second clevis 720 is pivotally mounted about these two rings 730 of the eccentric system 73.

Figure 12:
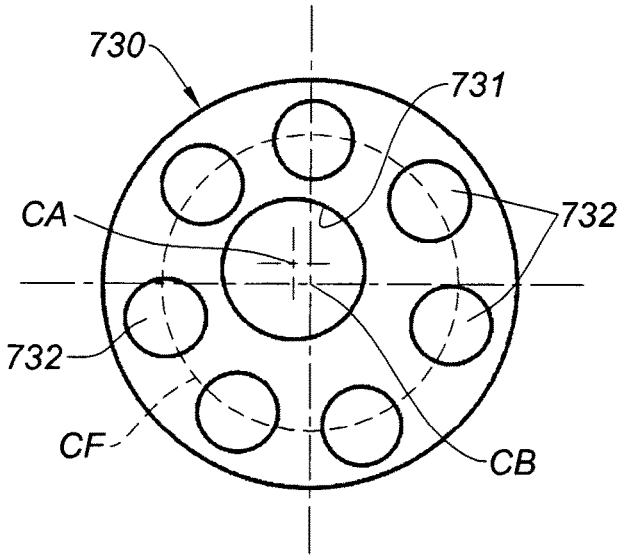
FIG. 12 is a side schematic view of a ring used in the eccentric system of the second hinge of FIG. 11.

Each ring 730 is provided with a cylindrical eccentric bore 731, that is to say that the center CA of the eccentric bore 731 is shifted relative to the center CB of the ring 730, as schematically illustrated in FIG. 12. In place, the pivot axis of the spacer 5, which should be aligned with the main pivot axis 35, therefore passes through the center CB of the ring 730 but does not pass through the center CA of the eccentric bore 731.

Each ring 730 is also provided with peripheral orifices 732 distributed around the eccentric bore 731, wherein these peripheral orifices 732 are regularly distributed along a fictional circle CF centered on the center CB of the ring 730, such that the peripheral orifices 732 are located at variable distances from the eccentric bore 731.

This eccentric system 73 further comprises a second shaft 733 provided with:

- two cylindrical portions 734 at its two respective ends; and
- a central portion 735 with a non-cylindrical section.

The central portion 735 of the second shaft 733 is received inside a housing 724 of a second support 725.

Figure 13:
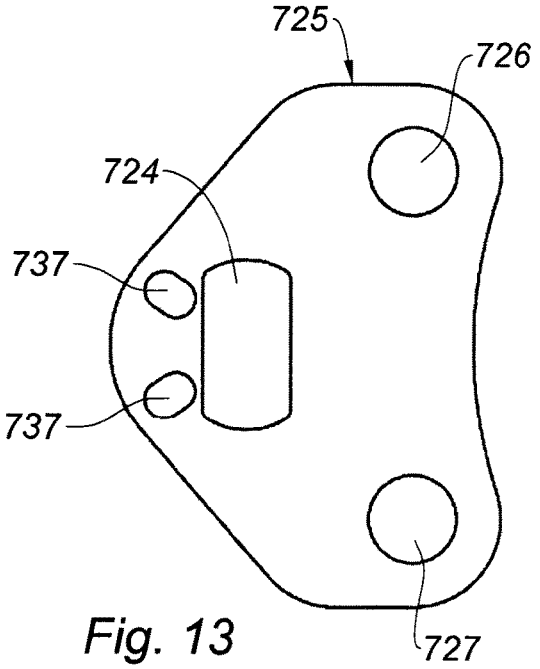
FIG. 13 is a side schematic view of a second support used in the eccentric system of the second hinge of FIG. 11.

Indeed, the second hinge 72 comprises a second support 725 which is in the form of a plate received between the two flanges 721 of the second clevis 720 and which has a housing 724 (shown in FIGS. 11 and 13) crossed by the second shaft 733.

This housing 724 is an oblong housing which has a shape complementary to that of the central portion 735. The central portion 735 has a substantially rectangular section and offers two opposing and parallel flat surfaces. The housing 724 also has a substantially rectangular shape, and the central portion 735 is slidably mounted inside the oblong housing 724, with its flat surfaces bearing on the inner faces of the housing 724 to guarantee a proper transmission of the forces between the spacer 5 and the jib 2. The housing 724 thus offers a setting clearance for the central portion 735 which authorizes, during setting with the eccentric system 73, a displacement for the second shaft 733 in the housing 724.

Thus, the second shaft 733 is mounted on this second support 725, and it passes through this second support 725 to be coupled to the rings 730 disposed on either side of the second support 725. In this manner, the eccentric system 73 is mounted on the second support 725 which is itself fastened on the jib 2 as described hereinafter.

The second shaft 733 has an inner hole 740 passing through and opening into the cylindrical portions 734.

The eccentric system 73 also comprises an immobilization device 736 arranged to immobilize the rings 730 on the second support 725 pivoting about the second shaft 733 in an angular position selected from several angular positions to allow correction of a misalignment between the first bearing 712 and the second bearing 722.

This immobilization device is in the form of a peg 736 which passes through one of the peripheral orifices 732 of one of the rings 730 and which also passes through the second support 725 to pass through the same peripheral orifice 732 of the other ring 730. Indeed, the peripheral orifices 732 allow, by means of the peg 736, immobilizing each ring 730 in different angular positions around the cylindrical portions 734 of the second shaft 733; each peripheral orifice 732 corresponding to a given angular position.

By acting on the passage of the peg 736 through either one of the peripheral orifices 732 of the rings 730 (these peripheral orifices 732 lying at different distances from the center CA of the eccentric bore 731), there is implemented a setting of the alignment of the pivot axis of the second hinge 72, which passes through the centers CB of the rings 730.

The peg 736 passes through the second support 725 across an oblong-shaped locking hole 737 formed on the second support 725. In the illustrated example, the second support 725 has two oblong-shaped locking holes 737 in order to be able to receive the peg 736 in any of the locking holes 737, which provides an additional degree of setting of the alignment of the axes.

Figure 11:
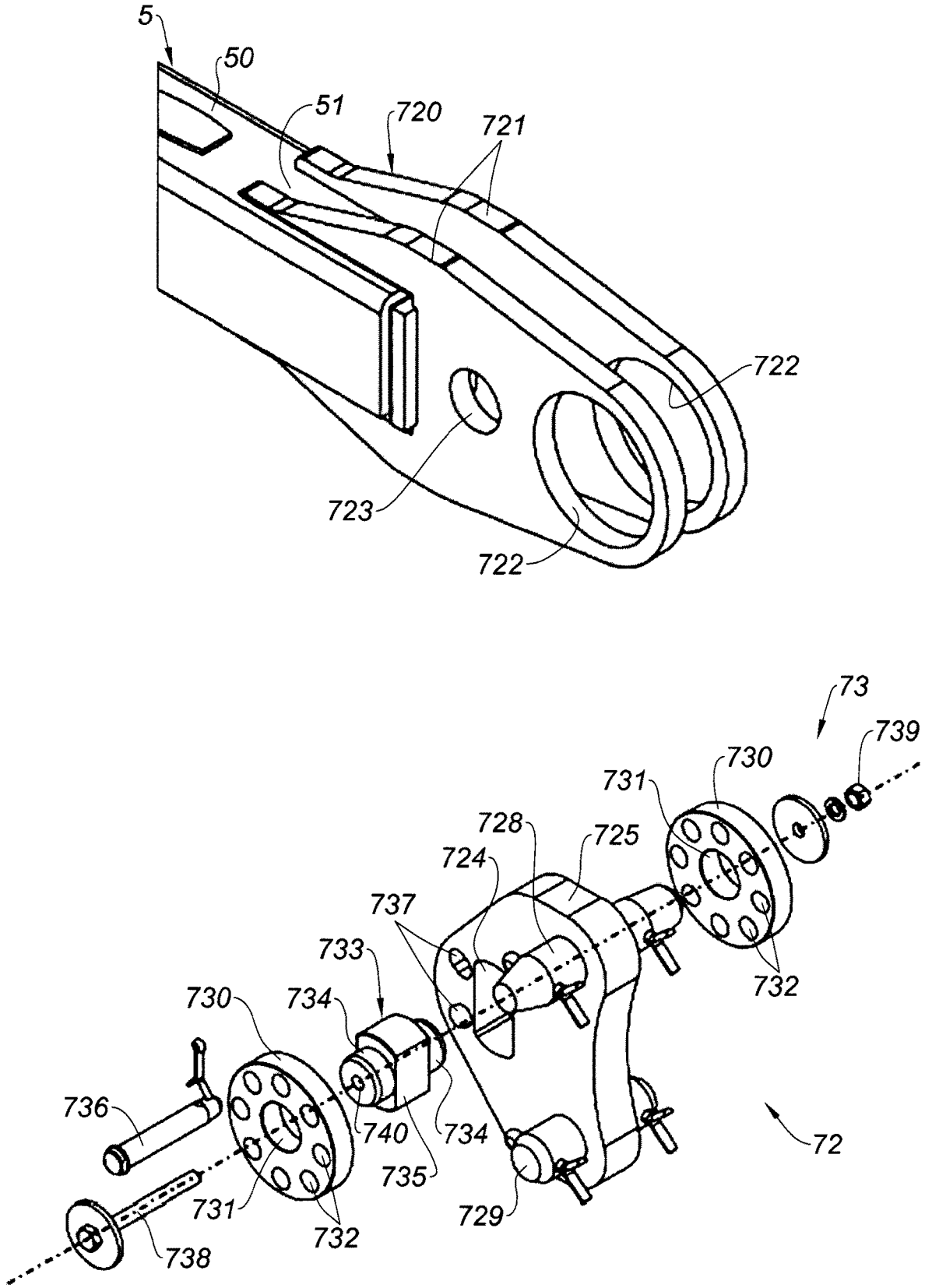
FIG. 11 is an exploded partial and perspective schematic view of the second hinge, according to an embodiment.

The peg 736 cooperates with at least one locking member such as a pin (as illustrated in FIG. 11), a nut, a socket, a circlip, or any other suitable means providing a blocking or locking in translation of the peg 736 on the rings 730.

The eccentric system 73 also comprises a locking device 738, 739 arranged to fixedly lock the rings 730 and the second shaft 733 on the second support 725. This locking device comprises a locking rod 738 passing through the second shaft 733 (across its inner hole 740) and thereby passing through the rings 730 and the second support 725.

This locking rod 738 is blocked on one of the rings 730 by means of an enlarged head and/or a washer, and its free end cooperates with a clamping member, such as for example a nut 739, possibly associated to a washer, wherein this nut 739 is clamped against the other ring 730, thereby clamping the two rings 730 and the second shaft 733 in the second support 725, which allows locking the eccentric system 73 inside the second bearing 722.

The second support 725 is also provided with:

- a cylindrical upper orifice 726; and
- a cylindrical lower orifice 727 disposed below the upper orifice 726 in a substantially vertical direction when the jib 2 is horizontal.

This second support 725 is fastened on the second stirrup 27, secured to the lower crossmember 25, by means of:

- an upper shaft 728 which passes through both the second stirrup 27 and the second support 725 across the upper orifice 726; and
- a lower shaft 729 which passes through both the second stirrup 27 and the second support 725 across the lower orifice 727.

Figure 14:
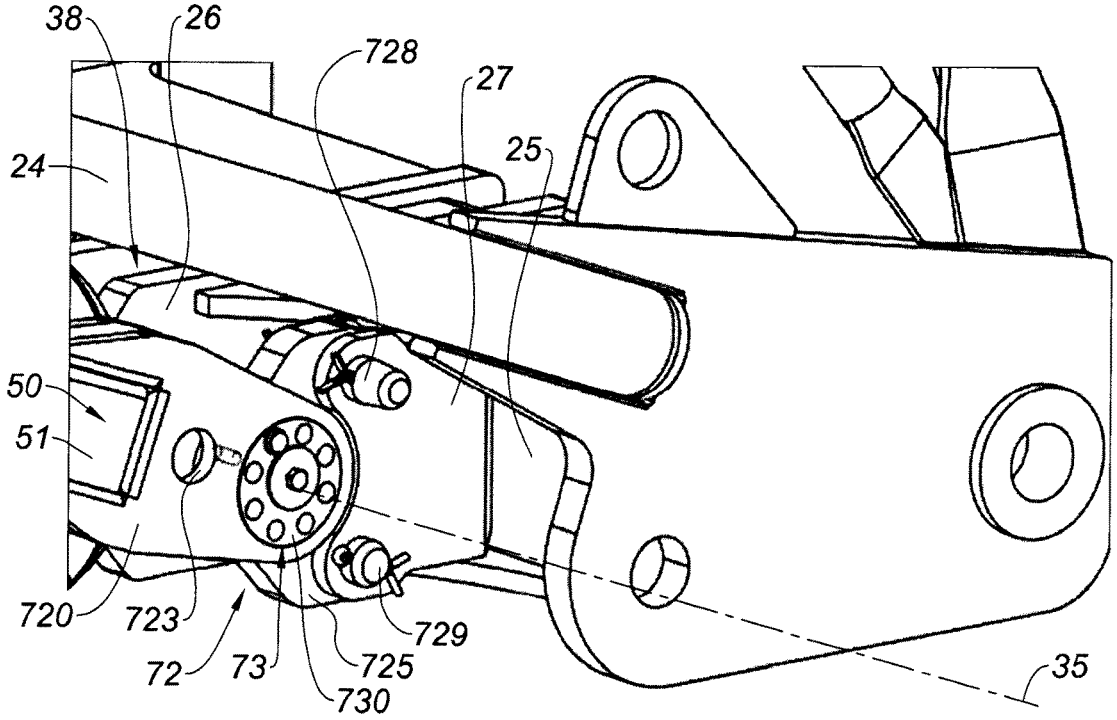
FIG. 14 is a partial and perspective schematic view of the second hinge of the spacer in place on the jib and in a service position, according to an embodiment.

The upper shaft 728 and the lower shaft 729 respectively cooperate with at least one locking member such as a pin (as shown in FIGS. 10 and 14), a nut, a socket, a circlip, or any other suitable means providing a blocking or locking in translation of the upper and lower shafts 728, 729 on the second stirrup 27.

Referring to FIGS. 14 and 15, the second hinge 72 is configurable between a service position (shown in FIG. 14) and a stowed position (shown in FIG. 15).

In the service position, the second support 725 is fastened and locked on the second stirrup 27 as described above, that is to say by means of the lower shaft 729 which passes through both the second stirrup 27 and the second support 725 across the lower orifice 727, and the upper shaft 728 which passes through both the second stirrup 27 and the second support 725 across the upper orifice 726.

In the stowed position, compared to the service position, the upper shaft 728 no longer passes through the second stirrup 27 and only the lower shaft 729, remaining in place on the second stirrup 27, provides for fastening of the second support 725 on the second stirrup 27. This second support 725 has undergone a downwardly pivoting tilting, by having pivoted about the lower shaft 729. Following this tilting of the second support 725, the second support 725 and the second clevis 720 have tilted downwards, thus clearing access to the central hinge 38 of the movable rod 31 on the jib 2. Thus, in this stowed position, it is possible to access the central shaft 39 and dismount it. The second stirrup 27 has concave endings 270 which are shaped to leave an axial passage for the central shaft 39 during it removal.

Following this tilting of the second support 725, the second support 725 is locked in this stowed position by means of the upper shaft 728 which passes through the two secondary orifices 723 of the second clevis 720 and the upper orifice 726 of the second support 725.

Thus, the second support 725 operates like a connecting rod between the service position and the stowed position.

It should be noted that the first hinge 71 is also configurable between a service position and a stowed position, identically to and concomitantly with the second hinge 72.

Furthermore, the spacer 5 comprises a distal portion 520 composed of the distal ends 52 of the two longitudinal beams 50, wherein this distal portion 520 supports the stop 6.

The two longitudinal beams 50 have a sufficient spacing to be able to extend on either side of the movable rod 31 in the locking position.

In the release position, the two longitudinal beams 50 extend obliquely relative to the movable rod 31, and extend in particular parallel to the lower beams 24 of the proximal portion 20 of the jib 2.

In the locking position, the two longitudinal beams 50 extend parallel to the movable rod 31.

The spacer 5 also comprises arcuate-shaped, or more specifically bow-shaped, crossmembers 53 so that the crossmembers 53 could match with the movable rod 31. These crossmembers 53 are positioned in the central portion of the longitudinal beams 50 and connect together the two longitudinal beams 50. In the illustrated example, the crossmembers 53 are secured to the same central part 530 fixedly extending between the two longitudinal beams 50.

The stop 6 is mounted on the distal ends 52 of the two longitudinal beams 50, extending transversely between the two longitudinal beams 50. This stop 5 has an arcuate shape, or more specifically bow-shaped, so that the stop 6 could match with the movable rod 31.

The stop 6 comprises:

- two slides 60 slidably mounted on the distal ends 52 of the respective longitudinal beams 50; and
- an arcuate central portion 61 extending between the two slides 60 and defining a groove 63 inside which the movable rod 31 is positioned in the locking position;
- two stop plates 64 fastened on the central portion 61, on either side of the groove 63, wherein these stop plates 64 define planar stop surfaces which are turned in the direction of (or which face) the bearing surface 410 of the bearing rim 41 in the locking position.

Each slide 60 is provided with a first orifice 65 passing therethrough, and each longitudinal beam 50 is provided, at its distal end 52, with a series of several second orifices 55 passing therethrough. Thus, the stop 6 can be selectively set in position on the spacer in a longitudinal direction 59 parallel to the longitudinal beams 50, using locking members in the form of two locking fingers 7 which are engaged both into a first orifice 65 and into a second orifice 55 selected from the different second orifices 55 providing several setting positions.

Each locking finger 7 may be blocked by means of blocking elements, such as for example a nut, a pin, a socket, a circlip, or any other suitable means providing a blocking or locking of the locking finger 7 on the corresponding slide.

Thus, according to the positioning of the locking fingers 7 in the second orifices 55, the stop 6 is more or less close to the proximal portion 510 of the spacer 5 and the main pivot axis 35.

This setting of the position of the stop 6 on the spacer 5 will allow setting the length of the movable rod 31 in the deployed holding position (described later on) and consequently setting the angle of the jib 2 in the raised holding configuration, which allows a setting of the reach of the jib 2 on the ground in this raised holding configuration.

The locking device 4 further comprises an actuator which includes a locking winch 9 (shown in FIGS. 2 and 3) equipped with a drum 90 on which a locking cable 91 is wound, which passes over pulleys and guides 92 disposed on the proximal portion 20 of the jib 2 up to the spacer 5.

Figure 7:
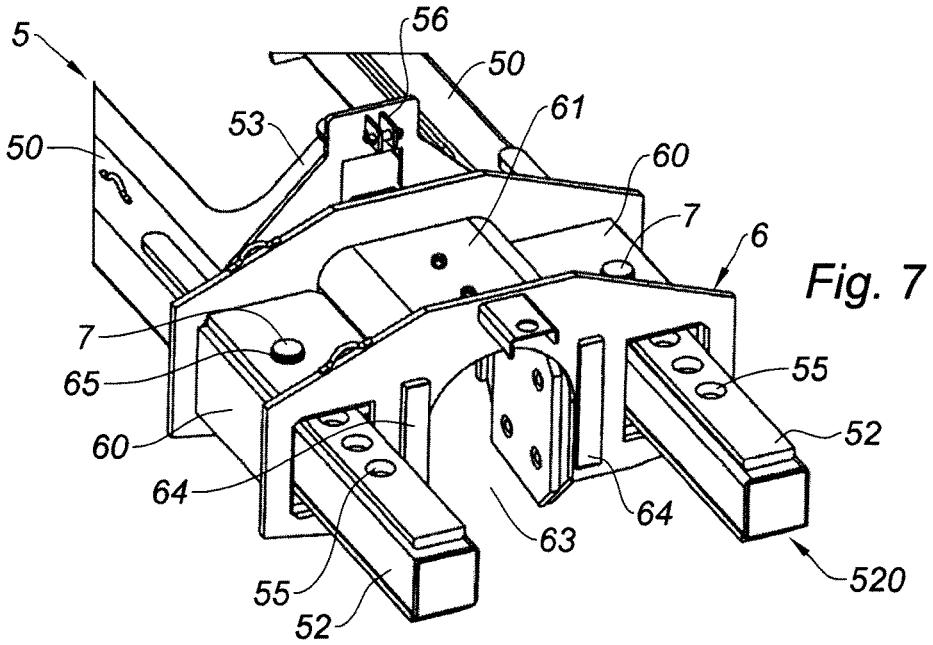
FIG. 7 is a partial and perspective schematic view of the spacer and its stop, showing the stop plates of the stop, according to an embodiment.

The spacer 5 comprises an anchoring element 56 (shown in FIG. 7) on which one end of the locking cable 91 is fastened. This anchoring element 56 is secured to one of the crossmembers 53, for example, to the crossmember 53 farthest from the proximal ends 51 of the longitudinal beams 50 to reduce the force required to raise the spacer 5.

Figure 2:
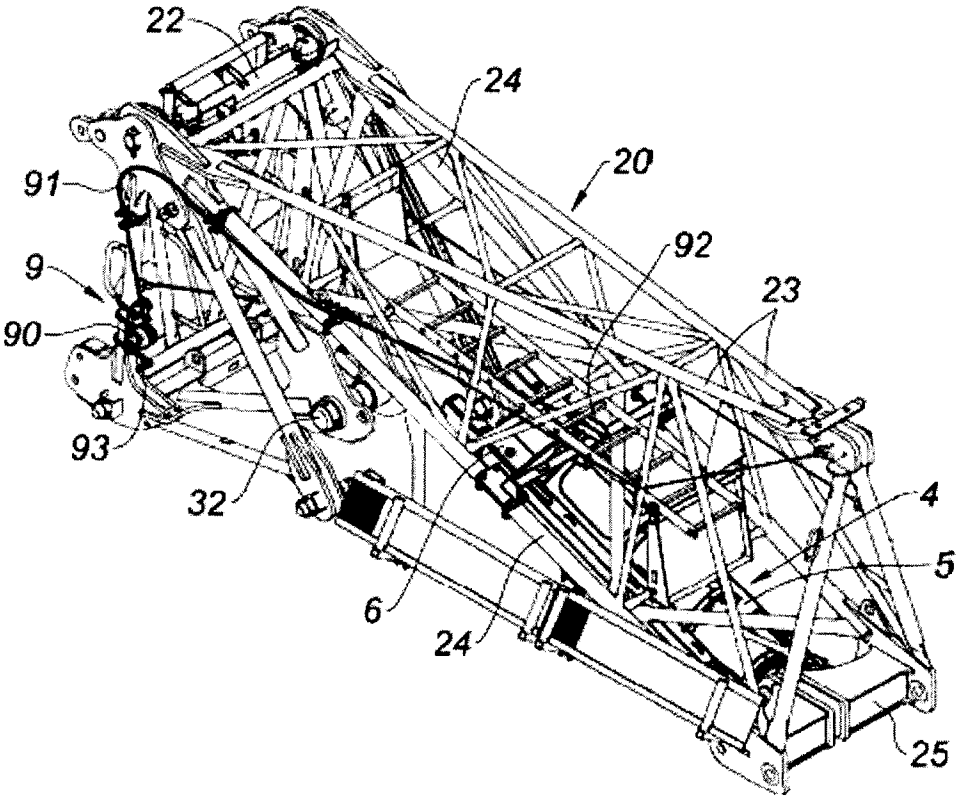
FIG. 2 is a top perspective schematic view of a proximal portion of the jib of the crane of FIG. 1, wherein the locking device is shown according to an embodiment.

This locking winch 9 is fixedly mounted on the proximal portion 20 of the jib 2 and the rotation of the drum 90 is performed either manually by means of a crank 93 (as shown in the example of FIGS. 2 and 3) or by means of a motor in one embodiment.

With this locking winch 9, the spacer 5 is displaced as follows:

- from the locking position to the release position, by rotating the drum 90 in the winding direction of the locking cable 91, which allows raising the spacer 5 by pulling it;
- from the release position to the locking position, by declutching the drum 90 to release the drum 90 in the unwinding direction of the locking cable 91, which allows the spacer 5 to be lowered by its own weight.

The locking device 4 thus enables the implementation of a locking sequence which results in a locking of the luffing jib 2 in the raised holding configuration (shown in FIG. 5). This locking sequence is carried out in three successive phases.

A first phase corresponds to a service phase wherein the spacer 5 is in the release position (shown in FIGS. 2 to 4) such that the movable rod 31 is free to be displaced within the cylinder body 30 to act on the displacement of the luffing jib 2, whether in lowering motion or in lifting motion. In this service phase, the movable rod 31 is free to be displaced within the cylinder body 30 up to a predefined maximum speed. Thus, the movable rod 31 may be displaced at the maximum allowed speed. In this service phase, the crane 1 is in use and is used for the distribution of loads.

A second phase corresponds to a transition phase wherein, starting from the service phase, the movable rod 31 is deployed up to a deployed transition position (shown in FIG. 4). This deployed transition position is located beyond the deployed holding position (described hereinafter) and is located close to a maximum deployed position, or even corresponds to a maximum deployed position (that is to say with the movable rod 31 at its maximum length extended from the cylinder body 30). On completion of this deployment of the movable rod 31 in the deployed transition position, the jib 2 is raised up to a raised transition configuration, which is raised higher than the deployed holding position.

In this transition phase, and following the deployment of the movable rod 31 in the deployed transition position, the spacer 5 is displaced from its release position to its locking position (shown in FIG. 4) by being folded over the movable rod 31.

A third phase corresponds to a locking phase wherein, following the transition phase, the movable rod 31 is retracted from the deployed transition position (shown in FIG. 4) to the deployed holding position (shown in FIGS. 5 and 6) until the stop 6 bears on the bearing surface 410 of the bearing rim 41 so that the spacer 5 fixedly holds the movable rod 31 in the deployed holding position, which results in locking the jib 2 in the raised holding configuration.

In this locking phase, the movable rod 31 is retracted to the deployed holding position at a reduced speed lower than the maximum speed.

On completion of the locking phase, the stop 6 therefore bears on the cylinder body 30, and in an embodiment, the two stop plates 64 bear on the bearing surface 410 of the bearing rim 41.

Once the locking device 6 has locked the jib 2 in the raised holding configuration, in other words on completion of the locking phase, a step of weathervaning the jib 2 is provided, in which includes a declutching of the jib 2 (by unblocking orientation brakes provided at the level of the rotating pivot 12) so that the jib 2 may freely rotate so as to be automatically oriented in the direction of the wind.

Of course, the present disclosure is not limited to the embodiments of this crane 1 with luffing jib 2 which have been described above, as example and it encompasses, on the contrary, all construction and application variants complying with the same principle. In particular, without departing from the scope of the invention:

- by modifying or completing the locking winch;
- by modifying the shape of the spacer and/or the stop.

The invention claimed is:

1. A crane comprising:

- a luffing jib;
- a lifting cylinder extending along a longitudinal axis and comprising a cylinder body mechanically connected to a structure element of the crane and a movable rod hinged on the luffing jib, wherein the movable rod is displaceable within the cylinder body between at least one deployed position and at least one retracted position to displace the luffing jib in lifting motion and in lowering motion between at least one raised configuration and at least one lowered configuration;
- a locking device adapted to cooperate with said lifting cylinder to mechanically lock the movable rod in a deployed holding position and thus block the luffing jib in a raised holding configuration, wherein said locking device comprises a spacer provided with a proximal portion hinged on the jib and a distal portion supporting a stop, wherein said spacer is pivotally movable on the jib between:
  - a release position in which the spacer is shifted opposite the lifting cylinder such that a distal portion of the spacer is brought away from the lifting cylinder, allowing the movable rod to be displaced within the cylinder body and to act on the displacement of the luffing jib; and a locking position in which the spacer is folded over the lifting cylinder such that the stop is capable of bearing on the cylinder body after a retraction of the movable rod;

wherein said cylinder body includes, at a front end crossed by the movable rod, a bearing device comprising:

a bearing rim having an annular upper surface forming a bearing surface for the stop; and a support ring fixedly mounted on the front end of the cylinder body, wherein the bearing rim is coupled to the support ring according to a ball joint connection with three rotational degrees of freedom; and wherein the movable rod is pivotally hinged on the jib according to a main pivot axis, and the proximal portion of the spacer is hinged on the jib according to a pivot axis aligned with said main pivot axis by means of a mechanical setting system enabling setting of the alignment between said pivot axes, such that, in a locking phase, the stop is bearing on the bearing surface of the bearing rim so that the spacer fixedly holds the movable rod in the deployed holding position to lock the luffing jib in the raised holding configuration, wherein said locking device is compressed between, on one side, the body of the cylinder and, on the other side, the jib with a compression force path aligned with the longitudinal axis of the lifting cylinder due to the bearing device which enables setting of the bearing of the stop on the body of the cylinder and, to the mechanical setting system which enables setting of the alignment of the pivot axes of the movable rod and the spacer.

2. The crane according to claim 1, wherein the bearing rim has an annular lower surface, opposite to the bearing surface, forming a first coupling surface, and the support ring has an annular upper surface forming a second coupling surface, wherein the first coupling surface and the second coupling surface are in ball-jointed bearing such that bearing of the stop on the bearing surface of the bearing rim which is evenly distributed on each side of the longitudinal axis of the lifting cylinder.

3. The crane according to claim 2, wherein one of the first coupling surface and the second coupling surface is spherical shaped, and the other of the first coupling surface and the second coupling surface is spherical or conical shaped.

4. The crane according to claim 2, wherein one of the first coupling surface and the second coupling surface defines a male bearing seat while the other of the first coupling surface and the second coupling surface defines a female bearing seat.

5. The crane according to claim 1, wherein the spacer includes a first longitudinal beam and a second longitudinal beam which have respectively:

proximal ends supporting respectively a first hinge and a second hinge which mechanically and pivotally connect the first longitudinal beam and the second longitudinal beam to the jib; and distal ends between which the stop extends;

wherein the movable rod has a front end supporting a central hinge which mechanically and pivotally connects the movable rod to the jib and is disposed between the first hinge and the second hinge, and said central hinge, the first hinge and the second hinge are all pivotable according to the same main pivot axis due to the mechanical setting system enabling setting of the alignment between the pivot axes of said hinges.

6. The crane according to claim 5, wherein:

the first hinge comprises a first cylindrical bearing, secured to the proximal end of the first longitudinal beam, pivotally mounted about a first cylindrical shaft mounted inside said first bearing, said first shaft being mounted on a first support fastened on the jib; and the second hinge comprises a second cylindrical bearing, secured to the proximal end of the second longitudinal beam, pivotally mounted about an eccentric system designed to correct a misalignment between the first bearing and the second bearing, said eccentric system being mounted on a second support fastened on the jib;

wherein said eccentric system constitutes the mechanical setting system enabling setting of the alignment between the pivot axes of the first hinge and the second hinge with the main pivot axis of the central hinge.

7. The crane according to claim 6, wherein the eccentric system of the second hinge comprises:

at least one cylindrical ring received inside the second bearing and provided with an eccentric bore;

a second shaft provided with a cylindrical portion received inside the eccentric bore of the ring, said ring being pivotally mounted about said cylindrical portion, said second shaft being mounted on the second support;

an immobilization device arranged to immobilize the at least one ring on the second support pivoting about the second shaft in an angular position selected from several angular positions to allow rectifying a misalignment between the first bearing and the second bearing; and a locking device arranged to fixedly lock the ring and the second shaft on the second support and thus to hold the eccentric system secured to the second support.

8. The crane according to claim 7, wherein the at least one ring is provided with peripheral orifices distributed about the eccentric bore, each peripheral orifice corresponding to a given angular position, and the immobilization device comprises a peg passing through the peripheral orifice corresponding to the selected angular position, said peg also passing through a locking hole formed on the second support and oblong-shaped to enable a displacement of the peg inside said locking hole during setting of the alignment between the pivot axes.

9. The crane according to claim 8, wherein the second support has at least two oblong-shaped locking holes in order to be able to receive the peg in any of the locking holes and thus provide two additional degrees of setting of the alignment of the pivot axes.

10. The crane according to claim 7, wherein the locking device comprises a locking rod passing through the second shaft and the second support to cooperate with a clamping member adapted to clamp the at least one ring against the second support in order to secure the eccentric system and the second support.

11. The crane according to claim 7, wherein the eccentric system comprises two identical rings disposed on either side of the second support, wherein the second shaft has two cylindrical portions at respective ends of the second shaft which are received inside the eccentric bores of the two respective rings.

12. The crane according to claim 7, wherein the second support has an oblong housing receiving the second shaft thereinside, wherein said second shaft has a central portion slidably mounted inside said oblong housing, such that the housing provides a setting clearance for the central portion which allows, during setting of the pivot axes with the eccentric system, a displacement for the second shaft in the housing.

13. The crane according to claim 6, wherein:

the first hinge comprises a first clevis provided with two flanges provided with opposing cylindrical main orifices defining the first bearing for the first shaft, the first support is formed by a plate received between the two flanges of the first clevis and provided with a cylindrical upper orifice and a cylindrical lower orifice crossed respectively by an upper shaft and a lower shaft, wherein the first hinge is configurable between:

a service position in which the first support is fastened and locked on a first stirrup secured to the jib by means of the lower shaft and the upper shaft which pass through the first stirrup and which pass respectively through the lower orifice and the upper orifice of the first support; and a stowed position in which, compared to the service position, the upper shaft no longer passes through the first stirrup and only the lower shaft, remained in place on the first stirrup, ensures fastening of the first support on the first stirrup after a pivoting tilting of the first support about this lower shaft clearing an access to the central hinge of the movable rod on the jib;

the second hinge comprises a second clevis provided with two flanges provided with opposing cylindrical main orifices defining the second bearing for the eccentric system, the second support is formed by a plate received between the two flanges of the second clevis and provided with a cylindrical upper orifice and a cylindrical lower orifice crossed respectively by an upper shaft and a lower shaft, wherein the second hinge is configurable between:

a service position in which the second support is fastened and locked on a second stirrup secured to the jib by means of the lower shaft and the upper shaft which pass through the second stirrup and which pass respectively through the lower orifice and the upper orifice of the second support; and a stowed position in which, compared to the service position, the upper shaft no longer passes through the second stirrup and only the lower shaft, remained in place on the second stirrup, ensures fastening of the second support on the second stirrup after a pivoting tilting of the second support about this lower shaft clearing an access to the central hinge of the movable rod on the jib.

14. The crane according to claim 13, wherein:

the flanges of the first clevis are provided with two opposing secondary orifices shaped so that, in the stowed position, the concerned upper shaft locks the first support by simultaneously passing through these two secondary orifices and the upper orifice of the first support; and the flanges of the second clevis are provided with two opposing secondary orifices shaped so that, in the stowed position, the concerned upper shaft locks the second support by passing through both these two secondary orifices and the upper orifice of the second support.

15. The crane according to claim 1, wherein the stop comprises an arcuate central portion defining a groove inside which the movable rod is positioned in the locking position, and stop elements are fastened on the central portion, on either side of the groove, wherein these stop elements face the bearing surface of the bearing rim in the locking position.

16. The crane according to claim 15, wherein the stop elements are in the form of stop plates defining flat stop surfaces adapted to abut against the bearing surface of the bearing rim.

17. The crane according to claim 1, wherein the crane is a tower crane.

18. A method for locking a luffing jib in a raised holding configuration, said method comprising:

in a first phase or service phase, providing a spacer in a release position such that a movable rod is free to be displaced within a cylinder body so as to act on the displacement of a luffing jib;

in a second phase or transition phase, deploying the movable rod up to a deployed transition position, beyond a deployed holding position, and displacing the spacer up to a locking position of the spacer by being folded over the movable rod; and in a third phase or locking phase, retracting the movable rod from the deployed transition position to the deployed holding position until a stop bears on a bearing surface of the bearing rim so that the spacer fixedly holds the movable rod in the deployed holding position so as to lock the luffing jib in the raised holding configuration.

19. The method according to claim 18, wherein, once the spacer and the stop have locked the luffing jib in the raised holding configuration, the method further comprises a step of weathervaning the jib including declutching of the jib so that the jib freely rotates so as to be automatically oriented in a direction of the wind.

* * * * *